US005209415A

United States Patent [19]

Brouwer et al.

[11] Patent Number: 5,209,415

[45] Date of Patent: May 11, 1993

[54] AIR TENSION FOR TAKE-UPS

[75] Inventors: Charles W. Brouwer, Greensboro; Larry C. Cowan; Thomas W. Perrino, both of Burlington, all of N.C.

[73] Assignee: John Brown, Inc., West Warwick, R.I.

[21] Appl. No.: 338,779

[22] Filed: Apr. 17, 1989

Related U.S. Application Data

[63] Continuation-in-part of Ser. No. 186,291, Sep. 26, 1988, abandoned.

[51] Int. Cl.[5] ..... B65H 59/38

[52] U.S. Cl. ..... 242/45

[58] Field of Search ..... 242/45, 75.5, 74.51, 242/75.52, 75.53

[56] References Cited

U.S. PATENT DOCUMENTS 3,047,247 7/1962 Kotte ..... 242/45
3,059,869 10/1962 Ash ..... 242/45
3,685,755 8/1972 King et al. ..... 242/45
4,518,126 5/1985 Marshall ..... 242/45
4,538,772 9/1985 Davies ..... 242/45

*Primary Examiner*—Stanley N. Gilreath
*Attorney, Agent, or Firm*—Breiner & Breiner

[57] ABSTRACT

A take-up unit for winding strand material comprising a strand-tensioning device having a compensator arm and a compensator wheel at a free end thereof for carrying a strand material to be wound and an air cylinder having means for receiving air under pressure is described. The air cylinder is interconnected with the compensator arm, thereby compensating for a change in tension of the strand material being wound. A plurality of strand-tensioning devices are interconnected with a common air supply, permitting the adjustment of the tension in the plurality of strand-tensioning devices by regulating the air feed from the common supply.

1 Claim, 2 Drawing Sheets

AIR TENSION FOR TAKE-UPS

RELATED APPLICATION

This application is a continuation-in-part of application U.S. Ser. No. 186,291 filed Apr. 26, 1988 of Charles W. Brouwer and Larry C. Cowan, now abandoned.

FIELD OF INVENTION

This invention is directed to improved strand take-up devices. More particularly, the invention relates to a strand take-up device in which air pressure is utilized to maintain tension on the strand material which is being wound. A plurality of take-up devices can be used in unison, with the plurality of devices being supplied with air from a central air source. In a preferred embodiment, a take-up is provided incorporating a compensator wheel having a linear displacement.

BACKGROUND OF INVENTION AND PRIOR ART

Take-up devices for winding strand material comprising a traverse roller-bail assembly and a spindle assembly conventionally utilize a strand tension control means to compensate for any change in tension during winding. The tension control means normally rely on a spring or a plurality of springs to achieve the tension ranges desired. The tension level is adjustable within the range of operative spring extension. Take-up devices having spring tension controls are commercially available from the Leesona Corporation under, for example, Model No. 959.

The use of a spring as a tensioning device has two deficiencies. A first deficiency results from the fanning angle of the traversing means during winding onto a package. As shown in FIG. 1 of the present drawing, the fanning angle extends from position A at one end of the yarn package being wound to position B at the center of the yarn package to a position C at the other end of the yarn package, and then again back to B to A. This sequence is repeated throughout the winding operation. The fanning angle induces an up-and-down motion to a compensator arm as shown in FIG. 1B. Since the compensator is directly connected to the tension-inducing spring, this motion causes tension variation which, when plotted, is as shown in FIG. 1A.

A second deficiency in a tensioning device utilizing springs is that each spindle must be individually adjusted to set the tension. Not only is substantial time involved in making each adjustment, but human error in the adjustment invariably causes tension variation in an installation utilizing a plurality of take-up devices as such devices are commonly employed. Also, in some winding applications it is preferable to reduce the applied tension as the package grows in diameter to avoid bulging of the package. This, therefore, requires a means for adjusting the tension over the course of winding a strand package.

There are disclosures in the prior art which suggest using a fluid such as air to compensate for yarn tension change in a winding operation. Note, for example, Keith et al, U.S. Pat. Nos. 3,534,922 and 3,641,756, assigned to the predecessor of the assignee of the present application. In the devices disclosed in the '922 and '756 patents, a fluid material such as air provides a cushion supporting a strand loop during winding. As the strand tension increases or decreases, the loop becomes smaller or larger, respectively. As a result of the need for providing an air cushion, there is a substantial utilization of and loss of air; and, accordingly, the devices are expensive to operate.

Brouwer et al, U.S. Pat. Nos. 3,464,452 and 3,477,476, also assigned to the predecessor of the assignee of the present application, disclose strand storage devices wherein yarn is guided into a helical loop and pressurized fluid within the loop is directed outwardly against the strand. As tension in the strand decreases, the strand expands outwardly to form a larger loop; and, as tension in the strand increases, the strand contracts to form a smaller loop. The inventions of the '452 and '476 patents have deficiencies similar to the deficiencies of the Keith et al patents.

Accordingly, there is a need for a tensioning means not subjected to the deficiencies of a tensioning device made according to the prior art.

SUMMARY OF THE PRESENT INVENTION

The present invention is directed to a take-up device having an air-controlled tensioning means. According to the invention, the mechanical spring of the conventional tensioning devices is replaced with an air cylinder, with the compensator arm being linked directly or indirectly to the air cylinder. In the air cylinder, the force which is a function of pressure (P) times area (A) remains constant and independent of position in contrast to a spring where the force increases with spring extension. Accordingly, tension remains essentially constant with fanning angle displacement, eliminating the peaks and valleys obtained with a spring as shown in FIG. 1A. As used herein, air cylinder is used in its broad sense and includes air-actuated diaphragms.

Additionally, when utilizing the air-controlled tensioning device of the present invention, it is possible to interconnect a plurality of the air cylinders, servicing the tensioning devices of the same plurality of take-up devices, to a common air source, permitting a tension adjustment to be made simultaneously to all of the plurality of take-up devices. This leads to a substantial savings in time and eliminates human variation and error.

In a particularly preferred embodiment, a take-up is provided incorporating a compensator wheel having a linear displacement. By using a compensator wheel having a linear displacement, it is possible to position the wheel to always bisect the angle formed by the approaching and departing yarn strand. Accordingly, whether the angle is 90 degrees or other than 90 degrees, the the yarn strand will always be equal. The compensator mechanism can move to create a change in the line speed without inducing a tension change in either the approaching or departing yarn, i.e., providing constant yarn tension.

According to the present invention, it is also possible to provide for tension-relieving as the package grows in diameter. This is accomplished by having the relieving force independent from the major tensioning device as will be apparent from the description hereinafter of one preferred embodiment of the air-controlled tensioning device of the present invention.

Having described the invention in general terms, a presently preferred embodiment will be described with reference to the drawing.

THE DRAWING AND PRESENTLY PREFERRED EMBODIMENT

Figure 1:
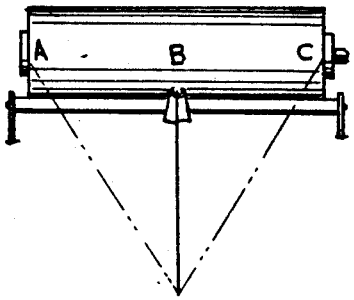
FIG. 1 PRIOR ART
FIG. 1 is a schematic view showing the fanning angle of the traversing mechanism as known in the prior art.
Figure 1A:
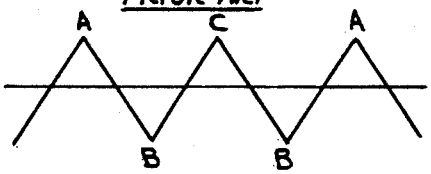
FIG. 1A PRIOR ART
FIG. 1A is a plot of the change in tension obtained with a spring-tensioning device when traversing from point A to point B to point C on a yarn package.
Figure 1B:
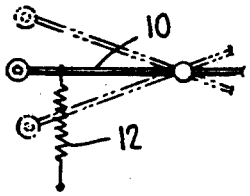
FIG. 1B PRIOR ART
FIG. 1B illustrates, schematically, the tension variation of a spring-tensioning device caused by the fanning angle in a prior art device.

Referring to the drawing, FIG. 1 illustrates the fanning angle obtained with a typical traverse mechanism during winding onto a package. FIG. 1B illustrates in solid lines the position of a compensator arm 10 controlled by a spring 12 at mid-point B of FIG. 1, and in phantom lines the position at points A and C. The plot of the tension variation with the prior art device illustrated in FIG. 1B is plotted in FIG. 1A. As is apparent, since the compensator arm is directly connected to the tension-inducing spring, the traverse motion causes a tension variation due to the increasing and decreasing forces on the spring. Moreover, as will be apparent, it is not possible to simultaneously adjust a plurality of devices having springs to provide a different tension simultaneously on all of the devices. Individual adjustment, as above stated, is time-consuming and is, additionally, subject to human variation and error.

Figure 2:
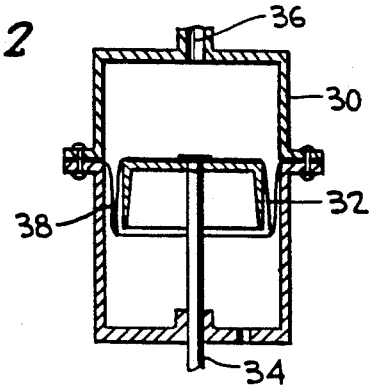
FIG. 2 is a cross-section of a preferred air cylinder for utilization in the present invention.

FIG. 2 illustrates a preferred air cylinder 30 for utilization in the present invention. The air cylinder comprises a piston 32 connected to a piston rod 34 and an air inlet 36. The piston disclosed utilizes a rolling diaphragm 38 which functions to keep inertia at a minimum.

Figure 3:
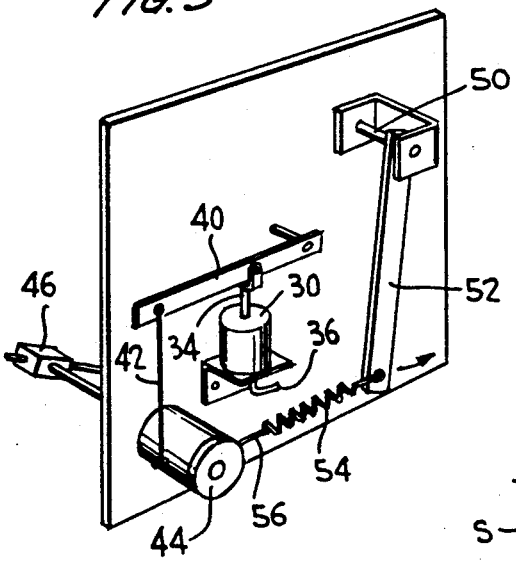
FIG. 3 is a first side of a tension compensator constructed according to the present invention having a tension relieving feature during a package's growth in diameter.
Figure 4:
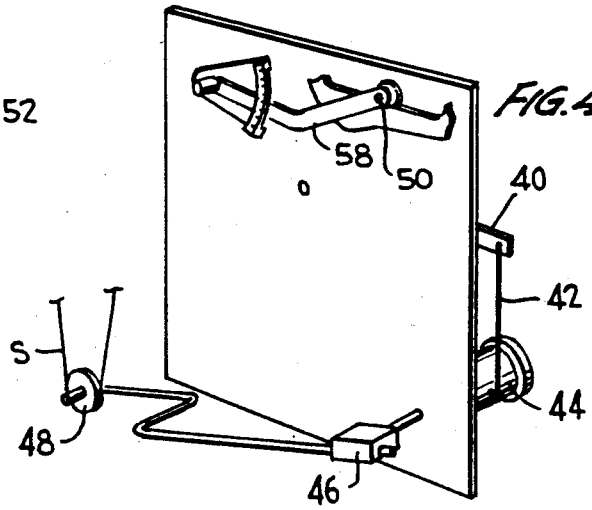
FIG. 4 is a second side of the tension compensator as shown in FIG. 3.

FIGS. 3 and 4 illustrate the first and second sides of a compensator constructed in accordance with the present invention. Referring first to FIG. 3, air cylinder 30 is supplied with air through inlet 36 which is connected to an air source through a precision regulator, not shown. The air pressure acts through piston rod 34 on lever 40 and cable 42 to effect an adjustable force on circular member 44. Circular member 44 is fixed to a compensator arm assembly 46 and applies a tension to strand loop S which circumscribes compensator wheel 48 as shown in FIG. 4. Since there is a strand loop passing through the compensator, one-half of the force applied is felt as package tension.

As above stated, some applications require the tension to relieve as the package builds in diameter. Shaft 50 is fixedly connected to lever 52. As the package diameter grows, causing shaft 50 to rotate, lever 52 moves in a counter-clockwise direction, increasing the force applied by spring 54. Spring 54 is connected by cable 56 to circular member 44 and, thus, to cylinder member 30 in a manner effecting an opposite force to that of the diaphragm cylinder and in this way relieves pressure as the package grows. The nature of the relieving pressure can be adjusted through arm 58.

Figure 5:
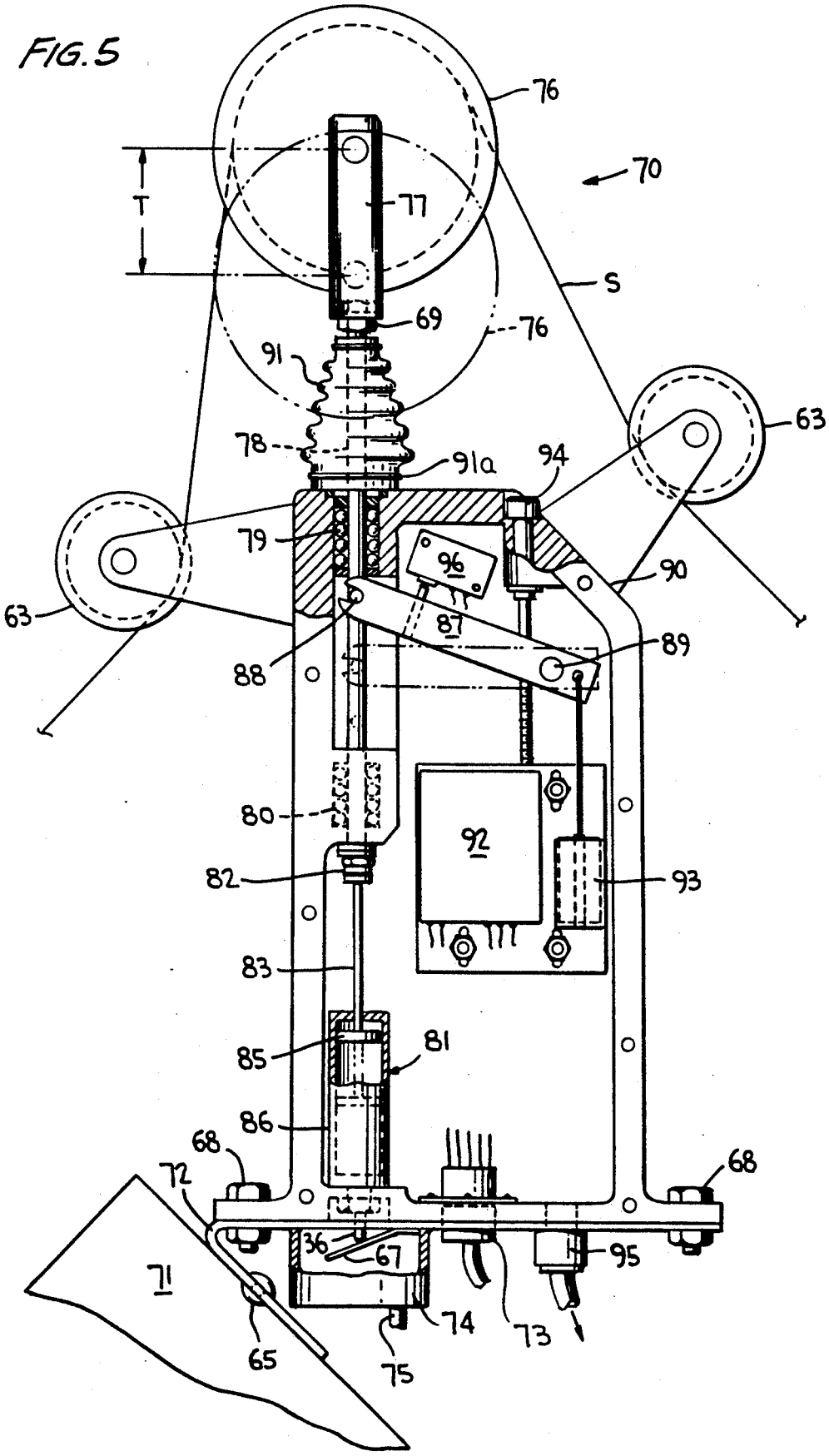
FIG. 5 is front view, with the front cover of the housing removed, partly in cross-section, of a particularly preferred embodiment of a take-up incorporating a compensator wheel having a linear displacement.

The take-up 70 illustrated in FIG. 5 utilizing the concept of the present invention is a completely self-contained modular unit having the front cover of housing 90 removed to illustrate the module components. The module is mounted on mounting bracket 72 with fasteners 68, and bracket 72 is attached at one end to a winder 71 with fastener 65. The module is plugged into an electrical connector 73. Air is supplied to volume chamber 74, which is mounted on bracket 72 or integral with winder 71, through air supply line 75 from a source not shown. Air, under pressure from chamber 74, flows to air actuator 81 through inlet 36 When module 70 is in place, inlet 36 opens flapper valve 67, allowing passage of air. To install or remove a unit on a winder, it is only necessary to disconnect electrical connector 73 and remove fasteners 68. When the module is off, flapper valve 67 closes the opening for inlet 36, avoiding contamination of volume chamber 74.

As further illustrated in FIG. 5, compensator wheel 76 carried by compensator support arm 77 is secured to compensator shaft 78 by a nut arrangement 69. The compensator shaft is carried in linear bearings 79 and 80, and connected through a ball joint 82 to piston rod 83, which in turn is connected to a piston 85 in cylinder 86 of air actuator 81. The travel T of the compensator wheel is adjusted through actuator lever 87 attached to actuator pin 88 on shaft 78. The actuator lever in turn is connected at its other end at pivot pin 89 to housing 90. The compensator shaft is sealed within housing 90 with flexible boot 91 and O-ring **91*a*. In some applications it can be desirable to have mounted on housing 90 one or more guide wheels 63 for controlling strand S. The additional wheels 63 increase the yarn strand wrap around compensator wheel 76 to more closely approach 180 degrees of wrap. This, in turn, reduces the amount of movement of the compensator arm 77** relative to the yarn loop take-up, which is desirable.

Housing 90 also carries a circuit board transducer 92 and coil transducer 93. The various functions of the take-up unit including speed variation are controlled through the circuit board transducer. The pressure applied on air actuator 81 to control tension is controlled by transducer 92, adjusted through external screw 94. The housing includes an air-purging system 95 for prevention of environmental contamination. A micro-switch 96 is constructed and arranged with lever actuator 87 to sense a broken yarn strand and, when sensed, stops the winding operation.

The modular take-up unit 70 is compact, requiring only approximately a one-inch center distance between yarn wheels. Accordingly, the unit is conveniently mounted on either single or multi-positioned take-up machines. The unit can be installed to function at any operating position including an up and down vertical, horizontal, or angular position. Regardless of the position, the movement is always linear with the wheel being positioned to always bisect the angle formed by the approaching and departing yarn. In this way the force on each leg of the yarn strand will always be equal. The compensator unit, therefore, can move creating a change in line speed without inducing a tension change in either the approaching or departing yarn whereby the yarn is always under constant tension.

Figure 6:
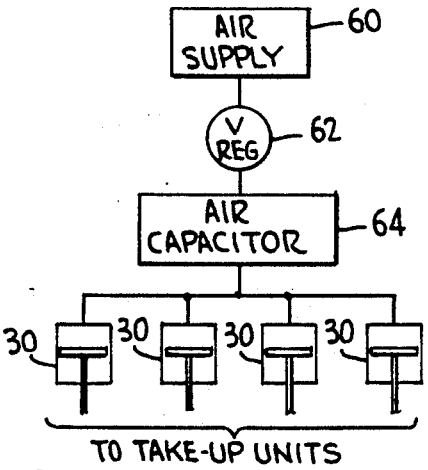
FIG. 6 illustrates, schematically, the utilization of a common air source for actuating the air cylinders of a plurality of air-controlled tensioning devices.

As shown in FIG. 6, a plurality of air cylinders 30 for a plurality of take-up units, not shown, can be fed air from a common air supply 60. Air from air supply 60 passes through a precision regulator valve 62, permitting the accurate control of air pressure to air cylinders 30. Preferably an air capacitor 64 of sufficient volume is positioned between regulator valve 62 and air cylinders 30 so that changing volume will not impact the pressure.

In accordance with the present invention, the air supplied to air cylinders or air diaphragms 30 is at a pressure varying from about 1 to 80 psig. The modification of pressure will permit for variation in the tension applied.

As will be apparent to one skilled in the art, various modifications can be made within the scope of the aforesaid description. Such modifications being within the ability of one skilled in the art form a part of the present invention and are embraced by the appended claims.

We claim:

1. A take-up unit or winding strand material comprising a strand-tensioning device having a compensator arm, a compensator wheel at a free end of said compensator arm for carrying a strand material to be wound, an air cylinder having means for receiving air under pressure, means interconnecting said air cylinder and compensator arm whereby the air cylinder applies a tension to the strand material being wound; said means interconnecting said air cylinder and compensator arm including a circular member and a force-relieving means comprising shaft means constructed and arranged to rotate as the brand material package is being wound and as the package diameter grows, a lever connected at one end to said shaft means and connected at the other end to a spring, said spring being interconnected with the said circular member.

* * * * *